US005570651A

United States Patent [19]

Schiff

[11] Patent Number: 5,570,651

[45] Date of Patent: Nov. 5, 1996

[54] SAILING VESSEL WITH ADJUSTABLE MAST

[76] Inventor: Peter Schiff, 4900 Forest Hill Rd., Cookeville, Tenn. 38501

[21] Appl. No.: 371,146

[22] Filed: Jan. 11, 1995

[51] Int. Cl.[6] ..... B63B 15/00

[52] U.S. Cl. ..... 114/91; 114/39.001

[58] Field of Search ..... 114/39.1, 89–91, 114/108, 109, 112, 111

[56] References Cited

U.S. PATENT DOCUMENTS

| | | | |
|---|---|---|---|
| 3,099,976 | 8/1963 | Schwaneke et al. | 114/91 |
| 3,610,190 | 10/1971 | Palmer | 114/91 |
| 4,094,263 | 6/1978 | Marcil | 114/91 |

FOREIGN PATENT DOCUMENTS

| | | | |
|---|---|---|---|
| 8700812 | 2/1987 | WIPO | 114/91 |

OTHER PUBLICATIONS

Photocopy –Navtec Rigging and Hydraulic Systems brouchure.

*Primary Examiner*—Edwin L. Swinehart

*Attorney, Agent, or Firm*—Waddey & Patterson; Mark J. Patterson

[57] ABSTRACT

A sailboat is provided with an adjustable mast system in which the base of the mast is pivotally attached to the top deck surface of the sailboat hull. Hydraulic cylinders connected to and integral with the shroud mast support system can vary the effective length of the shrouds, thereby tilting the mast to windward to maintain it in a vertical position while the boat hull is heeled.

5 Claims, 7 Drawing Sheets

SAILING VESSEL WITH ADJUSTABLE MAST

BACKGROUND OF THE INVENTION

The present invention relates generally to masts used to support sails on wind powered boats, and more particularly to a sail boat having a mast which can be adjusted in angle with respect to the boat hull.

It will be appreciated by those skilled in the art that when sailboats are sailed in a configuration other than "running" before the wind, that is, when the wind is coming from behind the boat, they experience considerable side thrusts imposed by the force of the wind. These side thrusts exist when the boat is on a "reach", sailing perpendicular to the wind, or when it sails upwind, at an angle of as little as 30 degrees to the apparent wind angle. The apparent wind angle is the true wind angle, altered by the forward velocity of the boat.

Due to the side thrust imposed by the wind, the boat "heels", or leans away from the wind. Heeling results in three detrimental effects which impair the performance of a sailboat having a conventional mast system in which the mast remains perpendicular to the top deck of the boat hull. First, the weight of the mast, now displaced by the heel of the boat, creates a force or torque that increases the heel. Second, the slanted sail causes a downward force and an associated heeling torque as the thrust of the wind pushes down on the sail that is angled toward the leeward side of the boat. Third, the wind acting on the sail that is displaced by the heel of the hull creates an increase in the heeling force proportional to the displacement of the sail plan from over the center of buoyancy.

Several techniques have been used in the prior art to reduce the heel angle of sailboats, in an effort to make the boat "stiff" and bring the mast to a more vertical position with respect to the surface of the water. A near-vertical mast is well recognized to improve sailing performance, especially for upwind sailing. One technique has been to employ high ballast/displacement ratios, typical of race boats. The high technology racing boats use deep drafts with comparatively heavy keel bulbs, combined with lightweight hull construction. The result is a stiff rig. Unfortunately, such boats are not designed for comfortable cruising situations. The deep draft certainly restricts their use. Construction costs are high. When the boat heels, as it inevitably will, the mast is not vertical, so even high performance boats are detrimentally affected.

Other boat designers have tried movable water ballast to counteract heeling forces. This requires extensive and expensive plumbing. The water ballast is shifted slowly rendering it unsuitable except for relatively long reaches. In the eventuality that the ballast ends up on the leeward side, the results are less than desirable. There are other inherent design limitations associated with water ballast. For example assuming a boat having a 15 foot beam, and a ballast moment arm that is 7 feet long, then it would take approximately 450 cubic feet of water to create a 182,000 foot-pound righting moment to achieve a vertical mast for a typical fifty foot sailboat. This volume of water would weigh 28,000 pounds. This clearly would not work, and even a reduced water ballast results in significant increases in hull displacement and associated flow resistance.

Swing-keels have also been tried. But, assuming the use of a keel with all of the 14,000 pound keel weight in the keel bulb, and further assuming an ability to swing the keel 60 degrees in each direction, then it would take a keel that extended 13 feet below the center of buoyancy to result in a vertical mast for a typical fifty foot sailboat. Needless to say, such a boat would have an excessive draft. Furthermore, a keel swung 60 degrees would no longer function well to stabilize the hull while tracking upwind.

What is needed, then, is a sailboat which is capable of maintaining its mast in a substantially vertical position when the hull of the boat is heeling due to forces of the wind. Such a sailboat is not found in the prior art.

SUMMARY OF THE INVENTION

An object of the present invention is to provide a sailboat with a mast system in which the mast can be maintained in a substantially vertical position regardless of the heel angle of the boat hull.

Another object of the present invention is to eliminate the need for swing heels, movable water ballast, and other expensive systems used to counteract the heeling forces generated by the wind against a sail.

Yet another object of the present invention is to provide an adjustable mast system for a sailboat which eliminates the need for expensive carbon fiber and other lightweight mast materials.

Accordingly, the sailboat of the present invention employs a mast system having a mechanism to position the mast into a vertical position, regardless of the heel angle of the boat hull. This results in the following advantages:

1. The downward force resulting from the wind pressure on the slanted sail is eliminated.

2. Elimination of the heeling torque due to the wind pressure on the sail displaced from over the center of buoyancy.

3. Elimination of the heeling torque resulting from weight of the angled mast and rigging.

4. The heeling angle of the hull is reduced.

5. There is no need for expensive, light weight carbon fiber masts and spars.

The result is a faster boat, because the wind no longer pushes the hull deeper into the water and the heel angle of the hull is lessened. These improvements in performance and sailing comfort are accomplished at less expense and with more dramatic results than achieved in the heel compensation systems currently employed in high performance sailing boats.

DESCRIPTION OF THE PREFERRED EMBODIMENT

Figure 4:
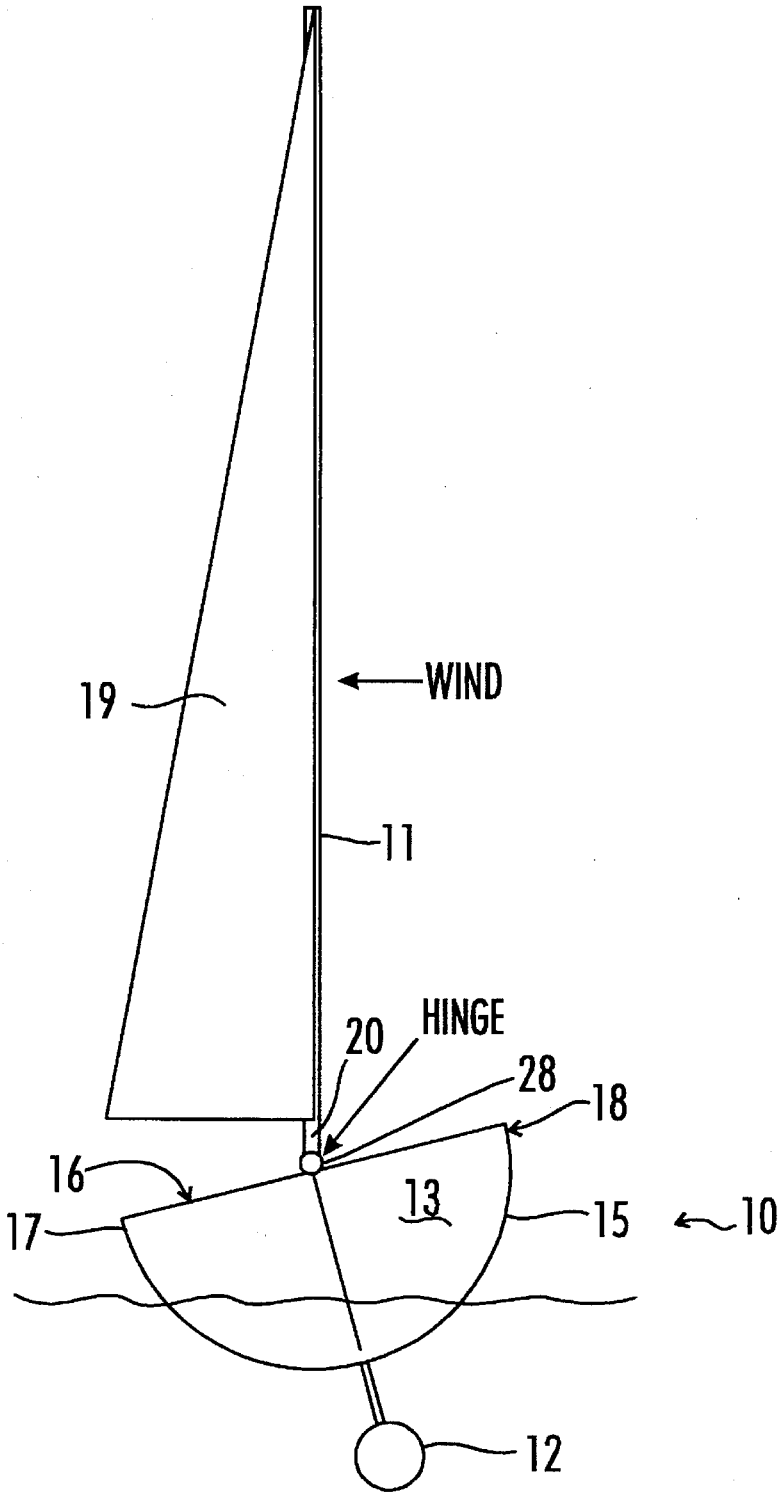
FIG. 4 is a view from the rear of the sailboat of the present invention showing the mast after having been adjusted to windward to assume a mast angle substantially perpendicular to the surface of the water.
Figure 5:
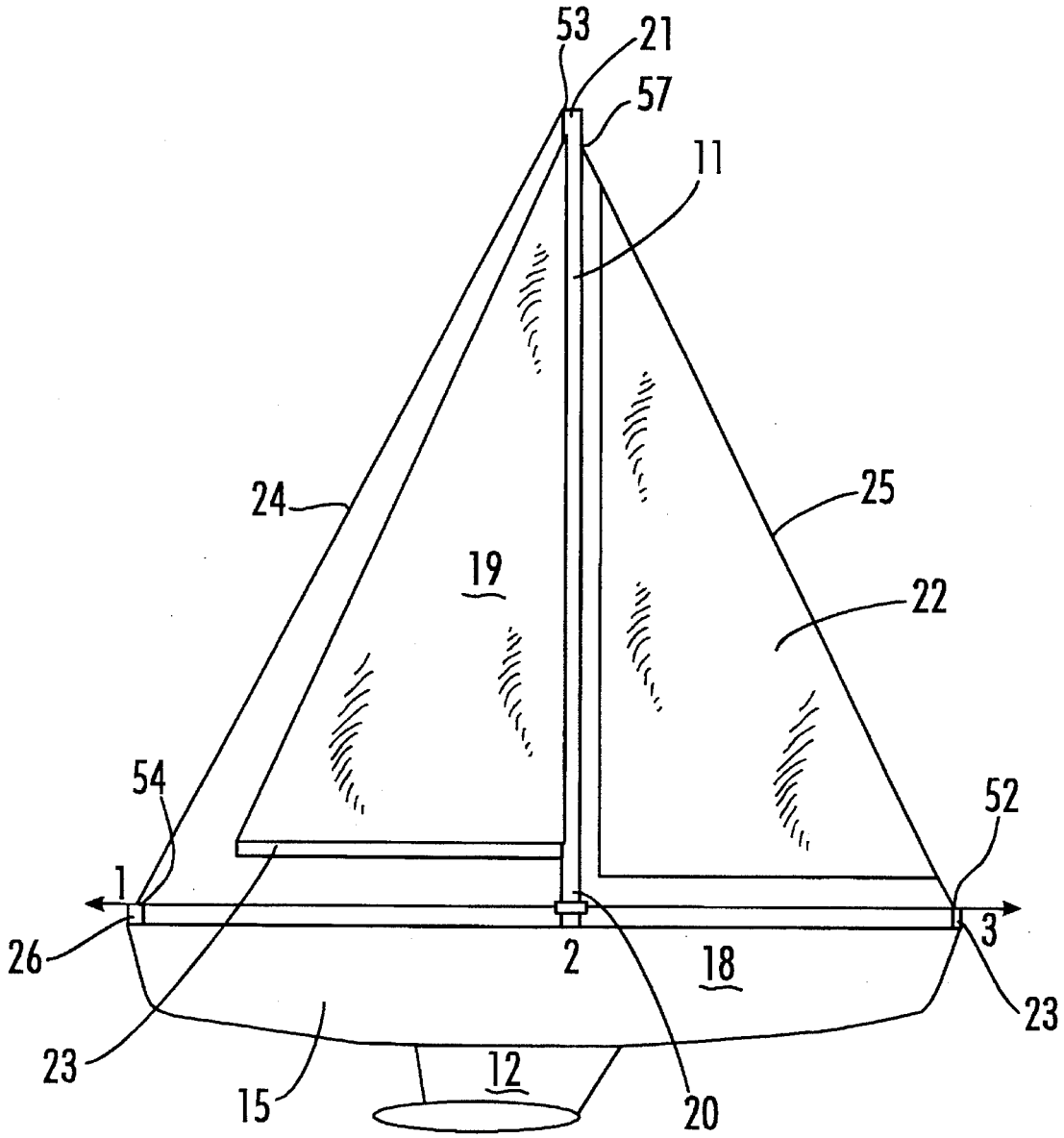
FIG. 5 is a view looking from the side of the sailboat of FIG. 4.
Figure 6:
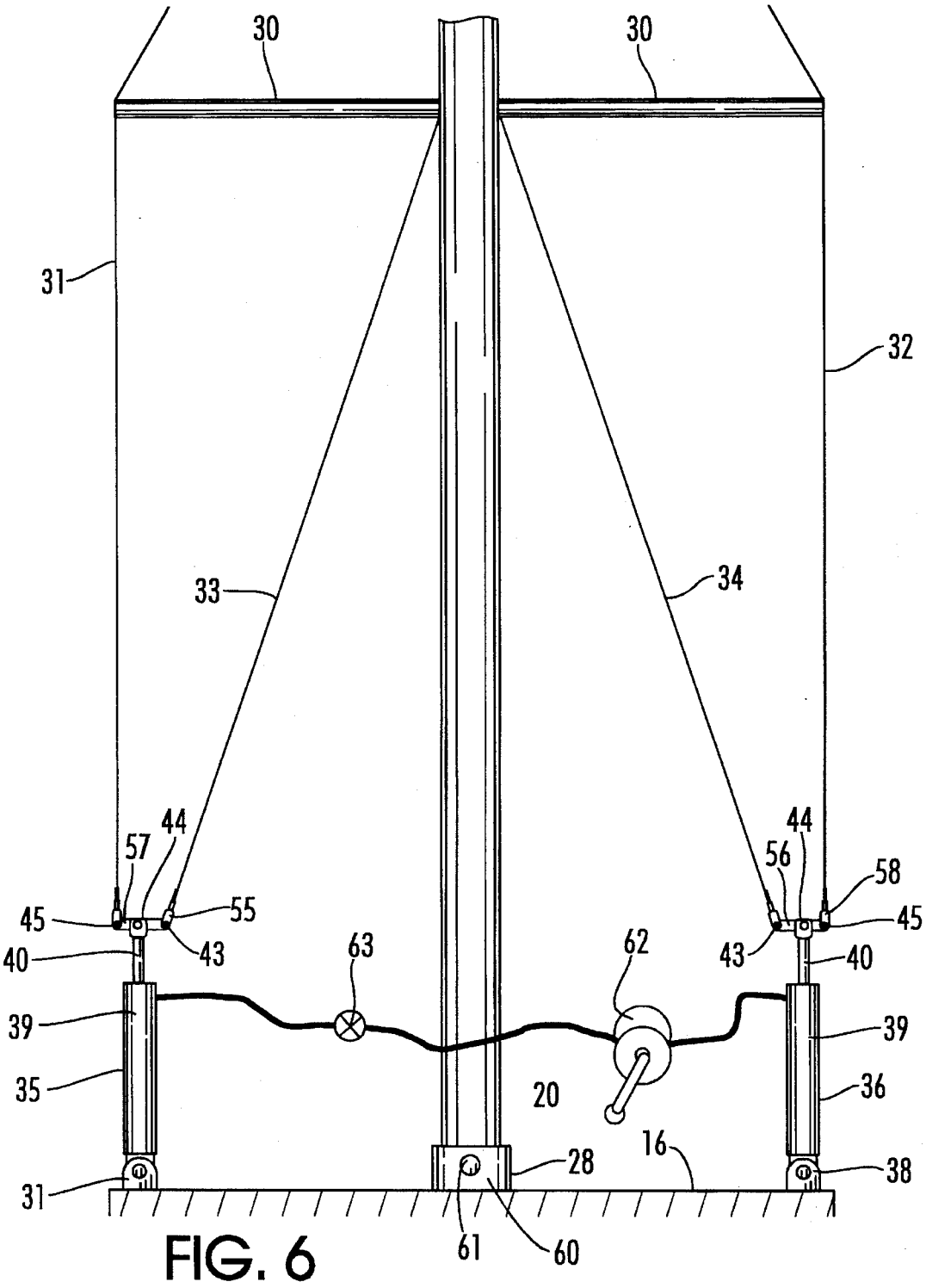
FIG. 6 is an enlarged view of the adjustable mast system of the present invention looking from the rear of the boat.

The improved performance achieved by the present invention can best be understood by creating a hypothetical sailboat that will serve as a mathematical model. Such a sailboat 10 is illustrated in FIGS. 4, 5, and 6. The sailboat 10 displaces 30,000 pounds, with a mast 11 that reaches 65 feet above the water line. For simplicity, assume that the only righting force is from a keel bulb 12 weighing 14,000 pounds. Further assume that, under full engine power, boat 10 moves through the water at 8 knots with a 95 horsepower engine, with 70 percent or 60 horsepower converted to forward thrust under these conditions. Thus:

60 hp×550 foot-pounds per second/1 hp=33,000 foot-pounds per second thrust 8 knots=8 knots×1.15 mph/knot×88 feet per second/60 mph=13.5 ft per second 33,000 foot-pounds per second/13.5 ft per second=2,444 pounds of forward thrust Thus, it requires 2,444 pounds of forward thrust to move boat 10 at a forward speed of 8 knots. If the engine is off and boat 10 is on a broad reach with the same forward speed of 8 knots, the wind must be generating a forward thrust of at least 2,444 pounds, without regard for the performance reductions of the heeling hull 15.

Figure 1:
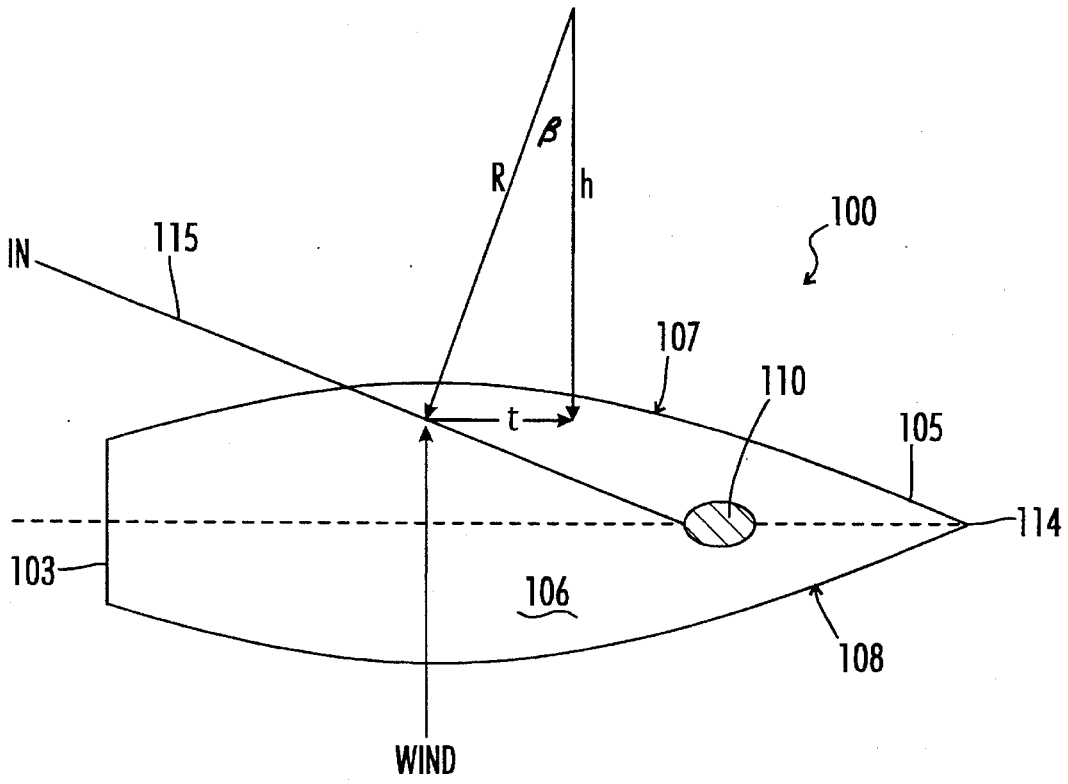
FIG. 1 is a plan view of a conventional sailboat, geometrically illustrating the effect of the side thrusts coming from the windward side of the boat, which in this case is the starboard side.

To further simplify the calculations, one can represent the mainsail 19 and jib 22 (FIG. 5) as if they are a single sail positioned at a 20 degree angle β to the longitudinal axis of the boat as shown in FIG. 1, and the apparent wind angle is exactly perpendicular to boat hull 15 (FIG. 5). For practical purposes, the wind exerts only a perpendicular force on the sail.

FIG. 1 shows a wind component and a sail reactance vector R pushing against the wind, with the resultant heel reactance force vector h and the forward thrust vector t, as applied to a conventional prior art sailboat 100. From the foregoing, the forward thrust vector t=2,444 pounds and various angles β of boom 119 result in the following wind pressure components:

| | | | |
|---|---|---|---|
| if | β = 30° | t/h = tan β | h = 4235 pounds |
| | β = 20° | | h = 6733 pounds |
| | β = 15° | | h = 9153 pounds |

As the sail angle β is diminished, the heeling force h increases dramatically to achieve a 2,444 pound forward thrust. For the conditions shown, a sail angle β of less than 20 degrees would result in excessive heeling forces.

Figure 2:
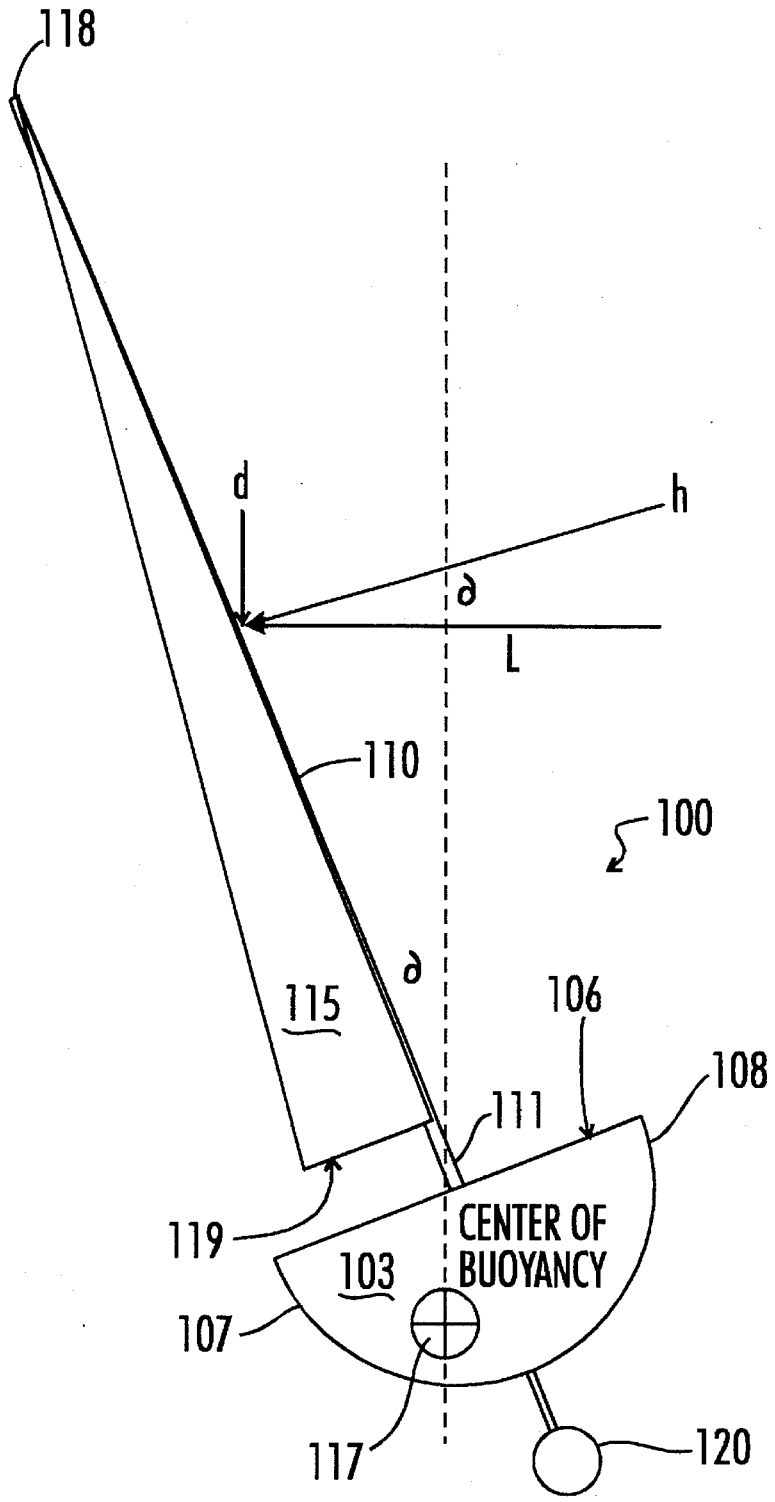
FIG. 2 is a view of the conventional sailboat of FIG. 1, looking from the rear, showing the heeling effects of the side thrust caused by the wind coming from starboard.

Looking at FIG. 2, if boom 119 is displaced at an angle β of 20 degrees from the longitudinal axis of boat 100, the wind force h perpendicular to the now slanted sail 115 can be separated into a downward component d and a horizontal component L. For several heeling angles α, the downward force component d can readily be calculated:

| | | |
|---|---|---|
| | α = heeling angle | d/h = sin α |
| if | α = 20° | d = 2302 pounds |
| | α = 15° | d = 1804 pounds |
| | α = 10° | d = 1171 pounds |

In other words, d represents the additional weight a conventional hull 105 must carry as boat 100 heels at angle α for a heeling force h=6733 pounds exerted by wind pressure. The more the boat heels, the greater the downward force d. For a typical heeling angle of 15 degrees, the downward force d adds the equivalent of 6% additional weight, as compared to the boat's displacement.

Figure 3A:
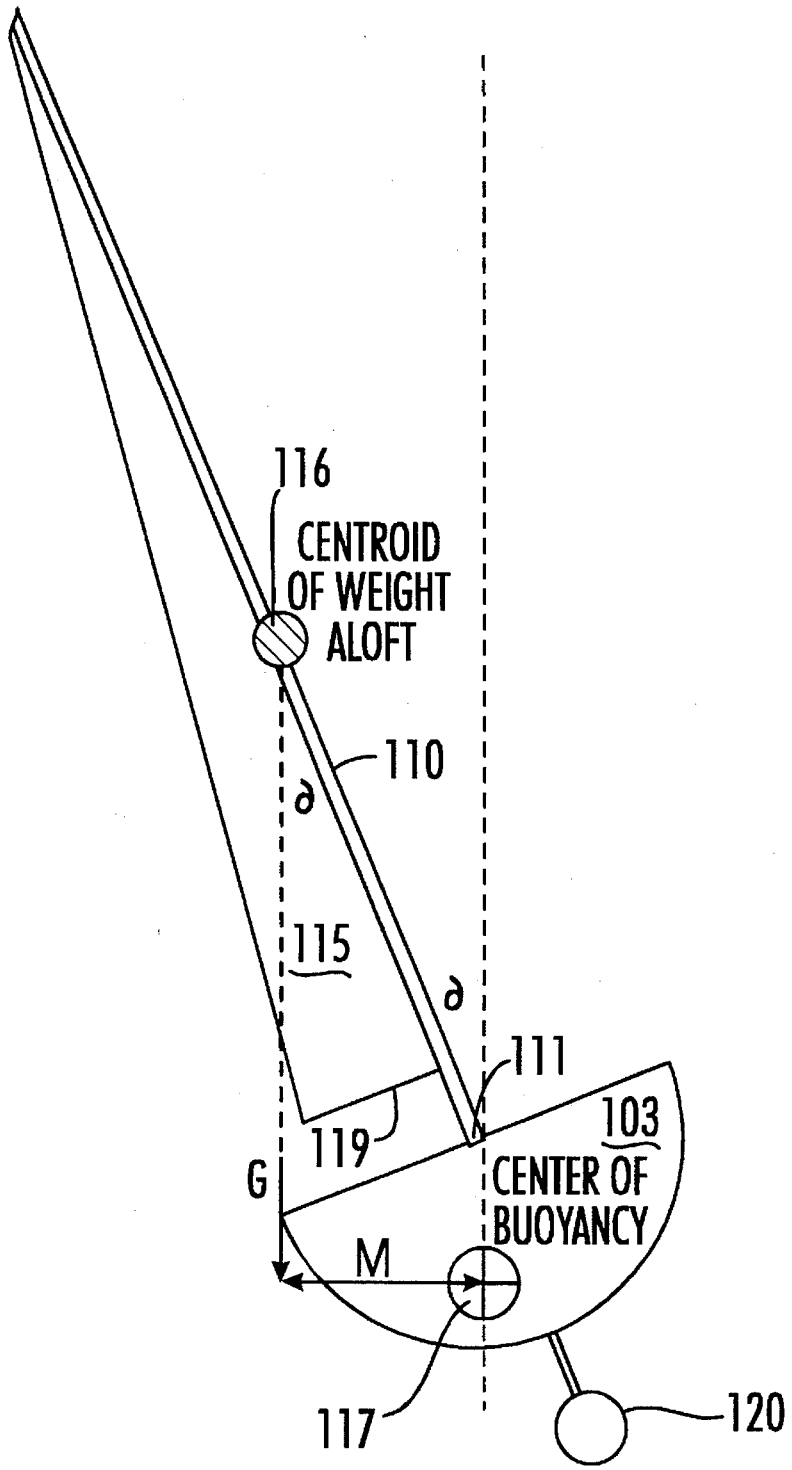
FIG. 3*a* is a view as in FIG. 2, showing the mathematical effects of the weight aloft of the mast and rigging.

Another factor that must be considered when boat 100 heels is the weight of the mast 110 and rigging aloft. If it is assumed that this weight is 1400 pounds and that its center of mass is 30 feet above the center of buoyancy point 117 then, as shown in FIG. 3, this weight aloft represents another force that will cause the boat 100 to heel even more. In this calculation, angle α is the heeling angle, G is the equivalent weight aloft, and M is the equivalent moment arm. The distance from the centroid of weight aloft 116 to the center of buoyancy 117 is 30 feet. Then:

$$\sin 15° = M/30 \text{ and } M = 8.04 \text{ feet}$$

With G being 1400 pounds, the weight aloft results in 1,400×8.04 or 11,256 pound-feet of heeling torque. To ascertain the overall effect of this, this factor can be compared to the wind's side torque T, calculated as follows:

T=h×distance from center of buoyancy to center of wind effort

Assuming a mast 110 which is 65 feet from its base 111 to its distal end 118, and the foot of sail 115 being 5 feet above the center of buoyancy 117, as in FIG. 2, the distance to the center of wind force on the sail plan is approximately 27 feet. This creates a wind side torque component of 182,000 foot-pounds. Comparatively, the weight aloft amounts to 6% of the wind's side torque force when the boat hull 105 heels at 15 degrees.

Figure 3B:
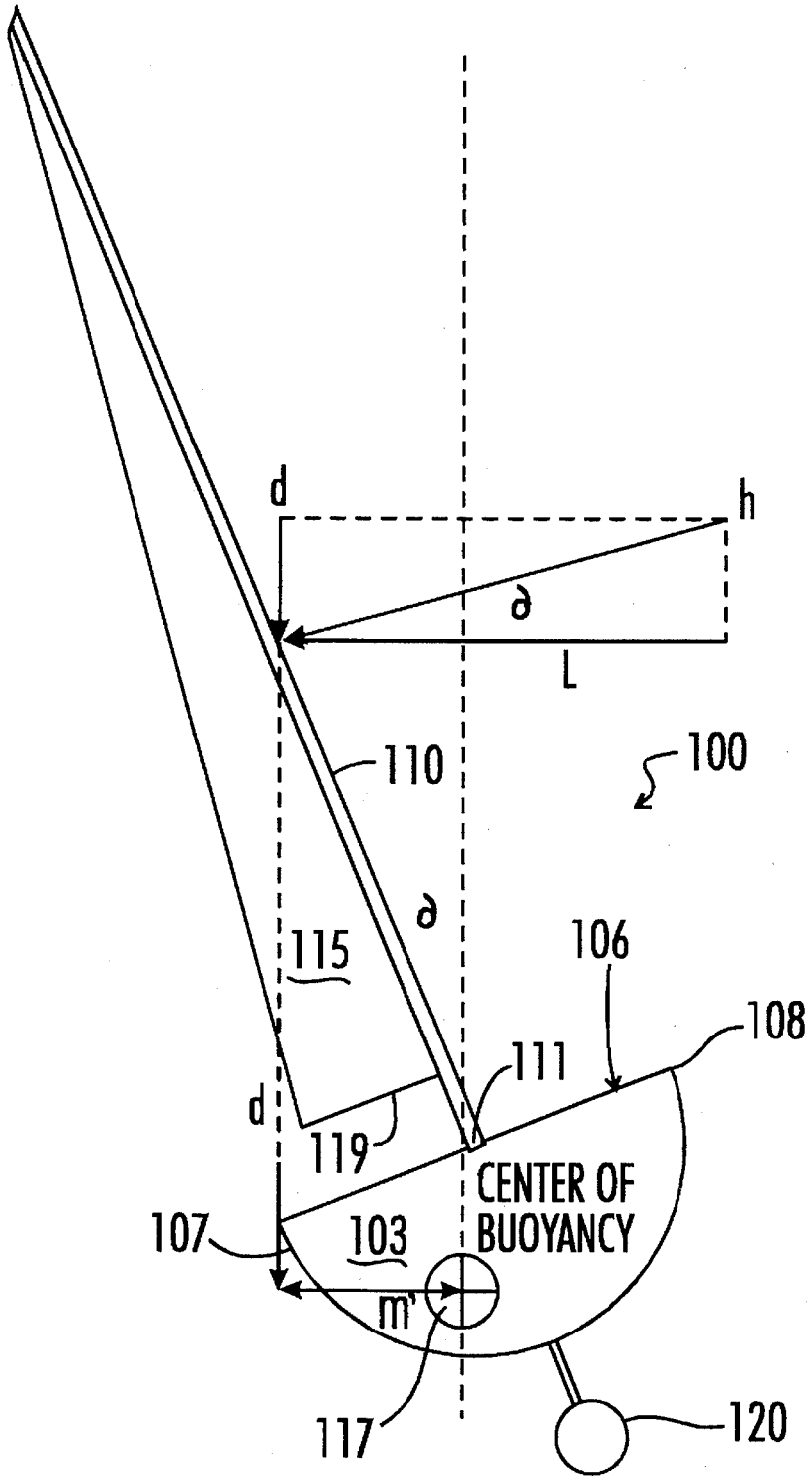
FIG. 3*b* is a view of the sailboat as in FIG. 3*a*, illustrating mathematically the effects of the wind aloft on heeling forces on the sailboat.

An additional detrimental effect of the wind's force is the torque that it creates in the form of its downward force d, as in FIG. 2, acting on the mast 110 which is displaced by heeling from over the center of buoyancy. As shown in FIG. 3*b*, m' is the horizontal distance from the center of buoyancy 117 to the centroid of wind thrust h as a result of the displaced sail plan. If, for conventional boat 100, this centroid of force is 27 feet above the center of buoyancy 117, then the downward force d at a heeling angle α of 15 degrees results in another heeling torque:

$$\tan 15° = 0.267 = m'/d = m'/27 \text{ and } m' = 7.2 \text{ feet}$$

$$\text{then the heeling torque} = d \times m' = 8.01 \times 1804 = 13{,}000 \text{ foot pounds}$$

This adverse torque is the result of displacement of the sail plan towards the leeward side (port side 107 of hull 105) of the boat 100 (FIG. 1). This torque represents 7.1% of the wind's side torque force when the boat 100 heels at 15 degrees. The greater the boom 119 angle β is (FIG. 1), the longer the effective moment arm m' becomes (FIG. 3*b*). The boom angle β is not incorporated in this calculation, so that even more than 13,000 foot-pounds of heeling torque is actually generated.

The solution to these adverse effects is found in the novel mast system of the sailboat of the present invention, illustrated in FIGS. 4, 5, and 6. Here, sailboat 10 has a hull 15 of conventional design, having a top deck surface 16, a bow 14, stern 13, starboard side 18, and port side 17. A bulb keel 12, also of conventional design, is attached to and extends downwardly from the bottom of hull 15.

To support a conventional mainsail 19 and jib sail 22, mast 11 is attached to and extends generally vertically upward from top deck surface 16 of hull 15 (FIG. 5). In order to incorporate the novel aspects of the present design of sailboat 10, base 20 of mast 11 terminates at top deck surface 16 rather than extending through to the bottom of hull 15 as in some prior art boats. Boom 23 supports and provides stability to the bottom or foot of mainsail 19.

To provide a supporting structure for mast 11, a forestay 25 is attached at its upper or first end 51 near distal end 21 of mast 11, and at its lower or second end 52 proximate to bow 14 of hull 15. A backstay 24 is attached at its first end 53 near distal end 21 of mast 11 and at its lower or second end 54 proximate the stern portion 13 of hull 15. Preferably, forestay 25 and backstay 24 are of conventional design, being made of stainless steel or similar wire rope, with swaged fittings at either end.

Looking more particularly at FIG. 6, as viewed from the stern, boat 10 will have at least one set and preferably two sets of lateral mast supporting members, in this embodiment, consisting of port upper shroud 31, port lower shroud 33, starboard upper shroud 32, and starboard lower shroud 34. Spreaders 30 extend laterally outward from the sides of mast 11 from a point intermediate distal end 21 and base 20. The top portions of port and starboard upper shrouds 31 and 32 are vertically stabilized by spreaders 30 as they extend upward to be attached to fittings proximate to distal end 21 of mast 11. The upper ends of port and starboard lower shrouds 33 and 34 are attached to fittings on mast 11 proximate the attachment points of spreaders 30.

So that mast 11 may be adjusted to varying mast angles with respect to hull top deck surface 16 and be positioned perpendicular to the surface of the water, mast 11 is attached to top deck surface 16 by swivel means 28, which can be a collar 60 mounted on deck 16 which supports a transversely oriented pivot pin 61. Pivot pin 61 passes through mast 11 at its base point 20. Collar 60 will have slotted openings (not shown) on the port and starboard sides so that mast 11 may be tilted to port or starboard.

The actual tilting of mast 11 is accomplished by increasing or decreasing the effective length of shrouds 31, 32, 33, and 34. Accordingly, lower ends 57 and 55 of port upper and lower shrouds 31 and 33 are attached to an extensible section 40 of port shroud cylinder 35. The lower ends 58 and 56 of upper and lower starboard shrouds 32 and 34 are similarly attached to extensible section 40 of starboard shroud cylinder 36. Extensible sections 40 of port and starboard shroud cylinders 35 and 36 move generally vertically in and out of fixed sections 39 of their respective port and starboard shroud cylinders 35 and 36.

To further facilitate the tilting of mast 11 to windward, whether it be to port side 17 or starboard side 18 of hull 15 (FIG. 4), port and starboard shroud cylinders 35 and 36 (FIG. 6) are pivotally attached to top deck surface 16 of hull 15 by port and starboard cylinder swivels 37 and 38 of a conventional design. Also, because the effective length of the shrouds change as mast 11 is tilted, lower ends 55 and 56 of port and starboard lower shrouds 33 and 34 are attached to an inner fitting 43 on port and starboard equalizer bars 41 and 42. Similarly, lower ends 57 and 58 of port and starboard upper shrouds 31 and 32 respectively are attached to outer fittings 45 on port and starboard equalizer bars 41 and 42. Center fittings 44 of port and starboard equalizer bars 41 and 42 are pivotally attached to the ends of extensible sections 40 of port and starboard shroud cylinders 35 and 36 respectively.

Using the system as described and shown in FIGS. 4, 5, and 6, the mast 11 can be tilted towards the windward side of the boat, typically up to 20 degrees toward either port side 17 or starboard 18. As shown in FIG. 4, this places mast 11 into a nearly vertical position, i.e., perpendicular to the horizontal plane established by the surface of the water. For optimal performance, the mast 11 is even slightly angled to windward. This will provide the following specific advantages compared with "rigid", non-adjustable masts:

1. Because the rigging and its weight now are directly over the center of buoyancy, the rigging weight no longer generates a torque that contributes to the heeling angle. This will reduce the heeling angle of the hull by about 6% or about 1 degree. As a matter of fact, the weight of the rigging is effectively neutralized, and the boat is much "stiffer".

2. The sail being vertical, it no longer generates a downward force d. (FIG. 2) due to the force of the wind acting on the sail. This will have the effect of making the boat 1804 pounds lighter (for the example shown), as compared to an unmodified boat heeling at 15 degrees.

3. With no downward force d, its torque component that normally adds to the heel angle is no longer present. As a result, the heel angle of the hull is reduced by another 1.1 degrees.

Actually, the combined effects of the above three factors compound the performance advantages. For instance, reduced effective weight means less friction at a given speed. A smaller hull heel angle means a reduction in water turbulence as the hull 15 (FIG. 4) moves through the water. This makes the hull 15 move faster and requires less forward force, which further reduces the side forces of the wind on the sails. The faster the boat moves, the faster the sails "get out of the way of the wind" as they slice through the air, reducing the side loads on the sail and boat.

As shown in FIG. 5, in order to tilt the mast, second end 52 of forestay 25 must be attached to the bow portion 14 of hull top deck surface 16 by means of a swivel fitting 27. Second end 54 of backstay 24 must be similarly attached at stern 13 using swivel fitting 26. The mast swivel 28, forestay swivel 27 and backstay swivel 26 must all be aligned along the longitudinal axis of hull 15, as shown in FIG. 5. For optimal performance, the swivel points should be kept low to the deck.

The mechanics of tilting the mast 11 are carried out by the shroud hydraulic cylinders 35 and 36 shortening the effective length of the shrouds on the windward side and increasing the effective length of the shrouds on the leeward side of boat 10, as shown in FIG. 6. In order to compress the starboard shroud cylinder 36 on the windward side and extend the port shroud cylinder 35 on the leeward side, the hydraulic fluid is simply moved from one cylinder to the other. This can be accomplished in a number of conventional ways, including by a gear pump 62 powered by a hand crank or electric motor. Once the mast angle tilt is set, a ball valve 63 is shut so that cylinders 35, 36 will stay in the position selected. An electrical controller can be added to maintain the mast positioning automatically.

The shroud cylinders 35 and 36 can serve an additional function by keeping the proper tension on the shrouds 31, 32, 33, and 34 while under sail. This is accomplished by adding additional fluid volume to them from a reservoir by means of an auxiliary pump (not shown). This can consist of a reciprocating piston type of pump with an internal check valve and a small adjustable bleed valve to return the fluid to the reservoir for reducing the tension in the shrouds, if necessary.

Another technicality that preferably must be addressed in an adjustable mast system is the necessity to lengthen and shorten the upper shrouds 31 and 32 going to the spreaders 30 as well as the lower shrouds 33 and 34 as the mast 11 moves. As shown in FIG. 6, equalizer bars 41 and 42 facilitate this. If the mast 11 has more than one spreader, all but the lower inside shroud lines are connected to one end of the equalizer bar. However, the point of attachment of the cylinders 35, 36 is proportioned closer to the multiple shroud end of the equalizer bar to maintain the same tension in all of the shrouds.

Thus, although there have been described particular embodiments of the present invention of a new and useful sailing vessel with adjustable mast, it is not intended that such references be construed as limitations upon the scope of this invention, except as set forth in the following claims. Further, although there have been described certain dimensions used in the preferred embodiment, it is not intended that such dimensions be construed as limitations upon the scope of this invention except as set forth in the following claims.

What I claim is:

1. A sail boat for use on a body of water, said sail boat comprising:

a. a hull, said hull having a top deck surface, a port side, a starboard side, a bow, and a stern;

b. a mast extending generally upward from said top deck surface at a mast angle with respect to said top deck surface, said mast having a base and a distal end;

c. mast angle adjustment means to adjust the mast angle of said mast both toward and away from said port side and starboard side of said hull, said mast angle adjustment means comprising means to move said mast distal end in a generally windward direction so that said mast is substantially perpendicular to a horizontal plane defined by the body of water, when said hull is heeled in a leeward direction;

d. said mast angle adjustment means further comprising mast swivel means for pivotally attaching said mast base to said top deck surface;

e. mast support means to support said mast, and said mast angle adjustment means further comprising support adjustment means for adjusting said mast support means when the mast angle is adjusted;

f. said mast support means comprising port and starboard upper shrouds, a forestay, and a backstay, said upper shrouds, forestay and backstay having first ends attached to said mast proximate said mast distal end, said port and starboard upper shrouds having second ends attached proximate to said port and starboard sides of said hull respectively, said forestay and backstay each having second ends attached proximate to said bow and stern respectively, and said mast angle adjustment means further comprising forestay and backstay swivel means for pivotally attaching said forestay and said backstay to said hull; and g. said mast support means further comprising port and starboard lower shrouds having first ends attached to said mast at points between said mast base and said mast distal end, said port and starboard lower shrouds having second ends attached proximate to said port and starboard sides of said hull respectively, and said support adjustment means comprising port and starboard equalizer means for compensating for variation in effective length of said port and starboard upper shrouds with respect to said corresponding port and starboard lower shrouds when the mast angle is adjusted.

2. The sail boat of claim 1, said shroud adjustment means further comprising means for varying the effective length of said upper shrouds and of said lower shrouds.

3. The sail boat of claim 2, said means for varying the effective length of said upper shrouds and of said lower shrouds comprising port and starboard hydraulic cylinders, said port cylinder having an extensible section connected to said second ends of said port upper and lower shrouds, said starboard cylinder having an extensible section connected to said second ends of said starboard upper and lower shrouds, said hydraulic cylinders each having fixed sections pivotally attached to said hull.

4. The sail boat of claim 3, said port and starboard equalizer means comprising port and starboard equalizer bars, each of said equalizer bars having inner, outer, and central portions, said central portions of said port and starboard equalizer bars pivotally attached to said extensible sections of said port and starboard hydraulic cylinders respectively, said second ends of said port upper and lower shrouds attached to said outer and inner portions of said port equalizer bar respectively, and said second ends of said starboard upper and lower shrouds attached to said outer and inner portions of said starboard equalizer bar respectively.

5. The sail boat of claim 4, further comprising means to control said hydraulic cylinders, said control means including means to adjust the tension of said upper and lower shrouds.

* * * * *